United States Patent [19]

Hamm

[11] 4,289,303

[45] Sep. 15, 1981

[54] HAND-RAIL ELEMENT FOR STAIRCASE

[76] Inventor: Wilfried Hamm, IM Wiesengrund 28, 4330 Mulheim an der Ruhr, Fed. Rep. of Germany

[21] Appl. No.: 56,930

[22] Filed: Jul. 12, 1979

[30] Foreign Application Priority Data

Jan. 25, 1979 [DE] Fed. Rep. of Germany ... 7901946[U]

[51] Int. Cl.[3] ..... E04H 17/14

[52] U.S. Cl. ..... 256/69; 285/397

[58] Field of Search ..... 256/59, 65, 21, 69; 138/139, DIG. 9, DIG. 8; 285/397

[56] References Cited

U.S. PATENT DOCUMENTS

| | | | |
|---|---|---|---|
| 28,647 | 6/1860 | Butler | 138/139 X |
| 60,655 | 6/1898 | Kelso et al. | 138/139 X |
| 95,614 | 10/1869 | Spear | 285/397 X |
| 337,100 | 3/1886 | White, Jr. | 138/139 X |
| 2,869,829 | 1/1959 | Spangberg | 256/65 |
| 3,570,545 | 9/1968 | Benteler | 138/143 |
| 4,193,585 | 3/1980 | Eandi | 256/65 |

*Primary Examiner*—Andrew V. Kundrat
*Attorney, Agent, or Firm*—McCormick, Paulding & Huber

[57] ABSTRACT

A hand-rail element has a metal pipe core, which is easily bent, and a soft plastic foam surrounding the pipe and having an outer surface contoured to simulate leather graining or the like. Several elements can be joined end-to-end by means of threaded nipples, and a hand-rail support is also disclosed, which permits assembly of these parts by a worker who need only use a portable power drill for on-site installation.

3 Claims, 3 Drawing Figures

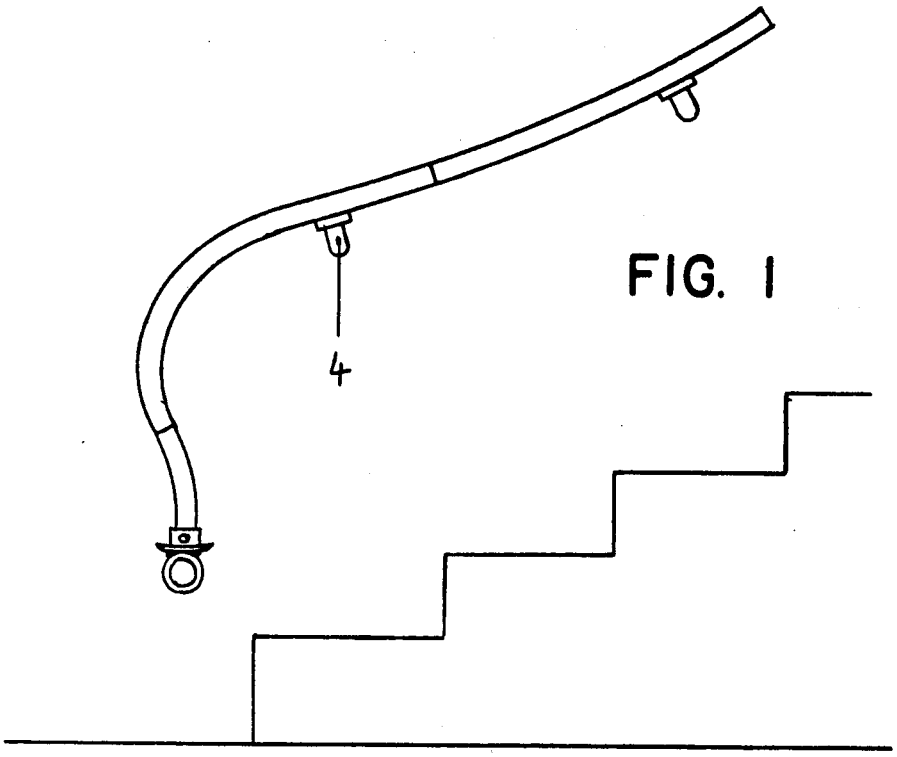
FIG. 1
FIG. 2
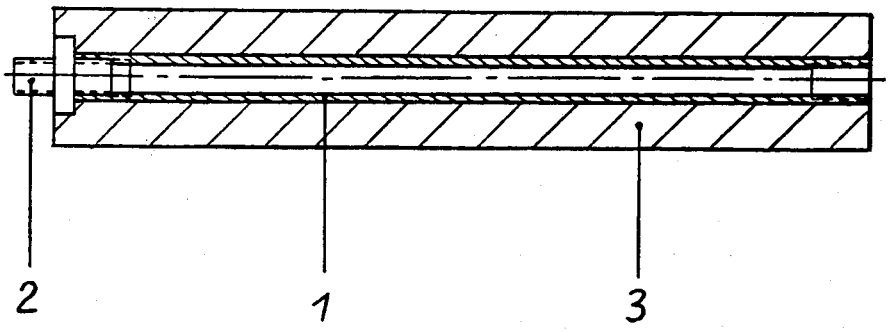

HAND-RAIL ELEMENT FOR STAIRCASE

BACKGROUND OF THE INVENTION

This invention relates generally to hand-rails for staircases, and deals more particularly with hand-rails which need not be individually adapted to the respective shapes of individual staircases. My hand-rail is well adapted to be mass produced whereas prior hand-rails must be installed by union tradesmen with bending and welding work done on the site. Inevitably such a hand-rail must be more costly than my improved hand-rail because of the less extensive work required for installation.

The object of the invention is to provide a hand-rail adaptable to any course of staircase without mounting aids. My unique hand-rail does not require bending equipment, is very easy to work up, and the production costs are lower than for prior hand-rails.

SUMMARY OF THE INVENTION

In carrying out my invention a metal pipe is surrounded by a soft integral foam which is easy to bend. This metal pipe may be of soft copper or other soft metals, around which a soft foam on a base of polyurethane is applied as a coating.

The pipe ends have interior threads at each end. Into the interior thread of one pipe end a double nipple is screwed in, and the nipple is also coated with plastic material. Thereby it becomes possible to produce a standard element length (of appr. 1 meter), these elements being easily screwed into nipples for connection with one another. A rather long hand-rail can be made from these short 1 meter elements. The hand-rail elements are pliable and easily molded into a continuous mounting of the entire hand-rail. Elements and nipples are screwed into each other, and also bent so that any desired course of the hand-rail is realized directly on the mounting site without great expense. Any excess on the end of the hand-rail need only be sawed off, and as with the beginning, the end provided with a closing gap.

A further special feature of the invention is the grained-leather-like surface structure of the hand-rail. It is easy to grasp, the hand-rail is weather-proof, and has little weight of its own.

The invention is to be explained in more detail with the aid of the accompanying drawings in which:

FIG. 1 shows a possible course of hand-rail.

FIG. 2 shows a hand-rail element in sectional view.

Figure 3:
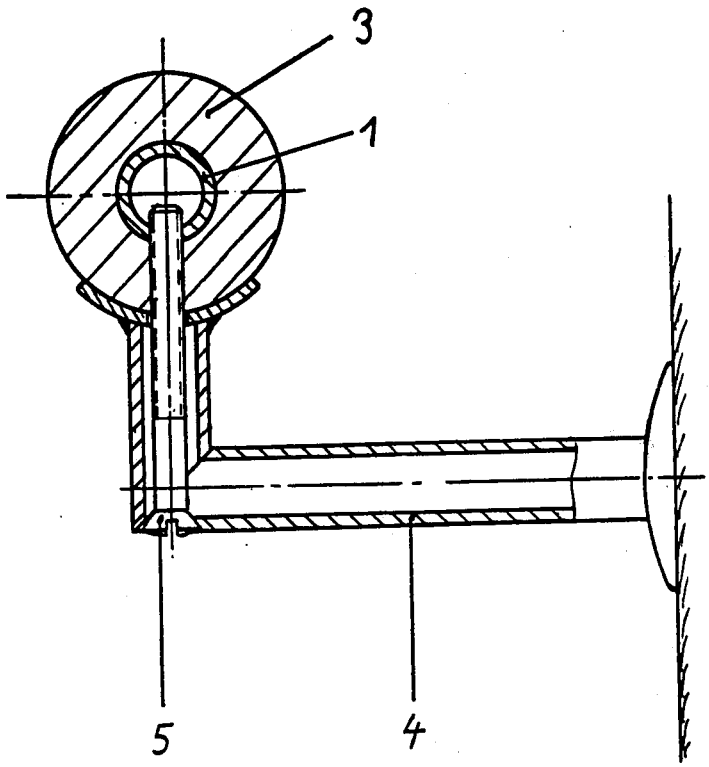
FIG. 3 shows the means for fastening the hand-rail to a wall.

The hand-rail element itself consists of the soft metal pipe (1), the double nipple fastened therein on one side (2) and the coating (3) made out of a soft integral molded plastic foam. Into the other end of the soft metal pipe (1) a female thread is cut corresponding to the male thread of the double nipple. The hand-rail support (4) is fastened to the hand-rail with a central screw (5), whereby this mounting requires only one hand held powered drill for installation. Thereby the respective hand-rail support (4) itself serves at the same time as a boring pattern or jig guide so that the whole mounting can be carried out quickly and safely.

The hand-rail element is universally applicable to any possible course of staircase, is easy to mount at the site, and is so designed as to have a very low production cost as well.

I claim:

1. A hand-rail assembly for a staircase comprising a plurality of hand-rail elements, each element having a soft metal core of tubular shape with a thin side wall thickness such that the metal core is easily bent by hand, each element having a pliable foamed polyurethane covering surrounding said tubular core and having a thickness at least approximately equal to the diameter of said core, a plurality of nipples connecting said hand-rail elements end-to-end, each nipple having opposed male threaded portions threadably received in the adjacent end portions of two end-to-end hand-rail elements, each nipple having a flange, and each pliable covering having one end recessed to receive said flange.

2. The hand-rail assembly of claim 1 further characterized by support means for said connected elements, said support means including support brackets each of which brackets has an upstanding post portion defining a saddle at its upper end for receiving said hand-rail elements, and an elongated screw extending lengthwise through said post portion and through a radial opening in one of said elements to be threadably received in said metal core.

3. The hand-rail assembly of claim 2 wherein the outer surface of said polyurethane covering is provided with a grained leather-like exterior.

* * * * *